US005924348A

United States Patent [19]

Schelli, III

[11] Patent Number: 5,924,348

[45] Date of Patent: Jul. 20, 1999

[54] INSULATION CUTTING GUIDE APPARATUS

[76] Inventor: William C. Schelli, III, 6215 S. Pershing Ave., Downer's Grove, Ill. 60516

[21] Appl. No.: 08/901,599

[22] Filed: Jul. 28, 1997

Related U.S. Application Data

[63] Continuation-in-part of application No. 08/826,581, Apr. 3, 1997, Pat. No. 5,806,391.

[51] Int. Cl.[6] ..... B26D 1/00

[52] U.S. Cl. ..... 83/455; 30/289; 30/294

[58] Field of Search ..... 30/286, 289, 290, 30/294; 83/455, 476, 762, 821

[56] References Cited

U.S. PATENT DOCUMENTS 4,987,812 1/1991 Benavidez ..... 83/455
5,075,974 12/1991 McIlhatten ..... 30/290
5,353,508 10/1994 Baker ..... 33/42
5,404,647 4/1995 Prater ..... 30/293
5,485,676 1/1996 Terhorst ..... 30/294

*Primary Examiner*—Douglas D. Watts
*Attorney, Agent, or Firm*—Henderson & Sturm

[57] ABSTRACT

An insulation cutting guide apparatus 10 for use with a cutting implement 101 to sever an unrolled sheet of insulation material 100. The cutting guide apparatus 10 includes a generally flat open framework member 20 having an elongated aperture 21 and provided with a knee pad member 30, a hand grip member 40, and an alignment member 50. The framework aperture 21 is dimensioned to receive, and at least one side of the aperture 21 is designed to guide, the cutting implement 101 during the severing of the insulation material 100.

10 Claims, 1 Drawing Sheet

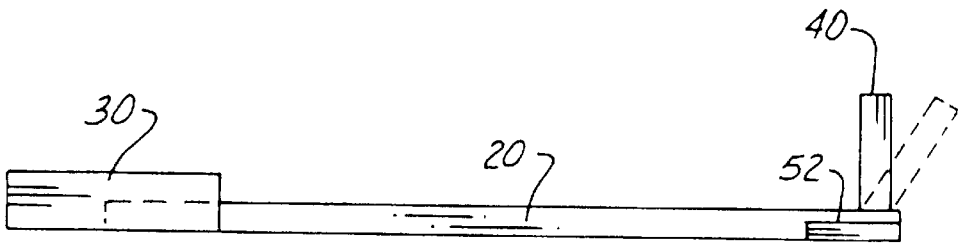
Fig. 3
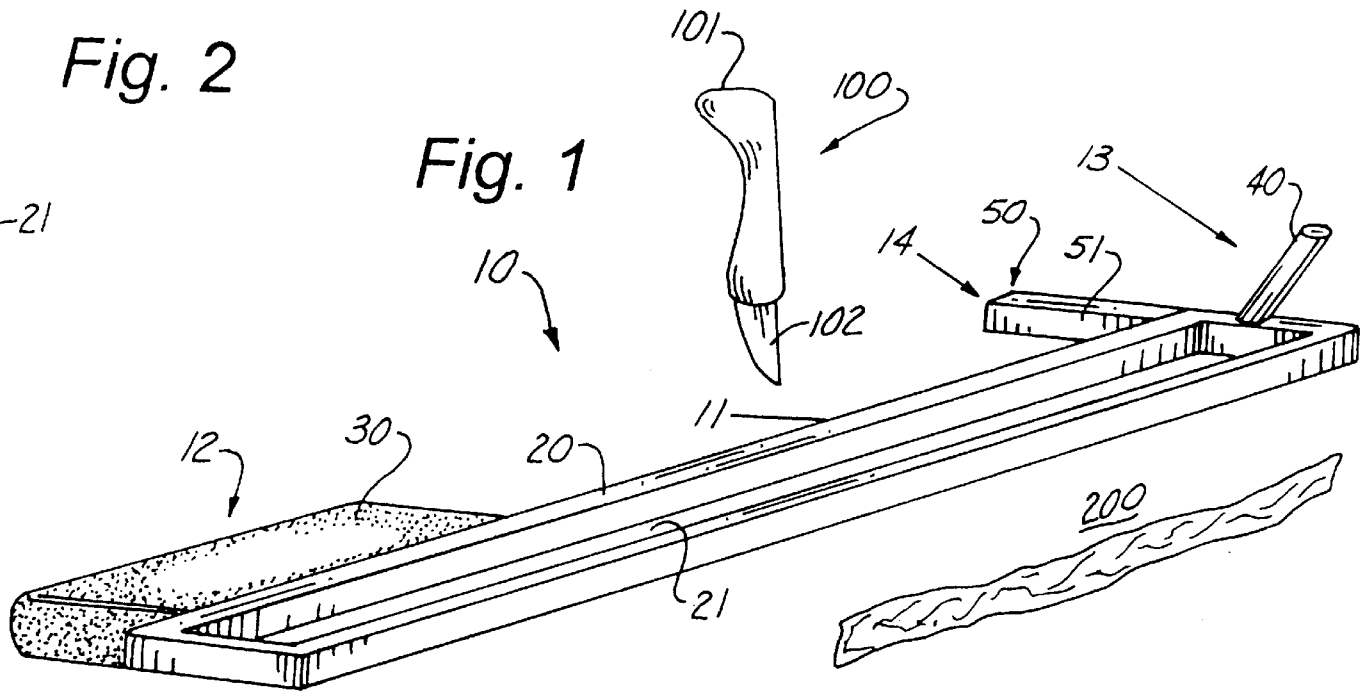
Fig. 1
Fig. 2
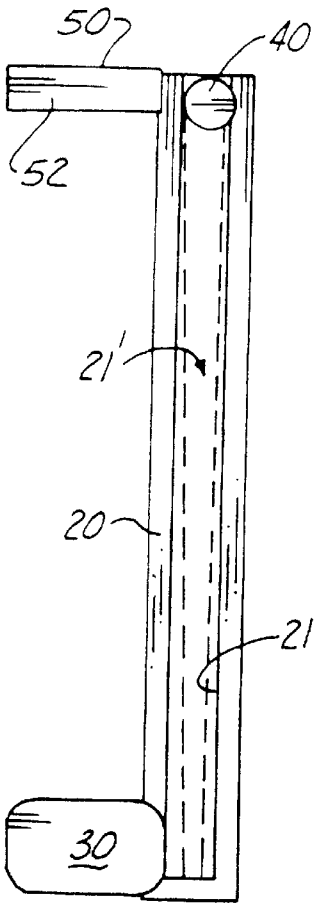

INSULATION CUTTING GUIDE APPARATUS

CROSS REFERENCE TO RELATED APPLICATIONS

This application is a continuation-in-part application of my U.S. patent application Ser. No. 08/826,581 filed of Apr. 3, 1997 entitled "Insulation Cutting Guide Apparatus", now Pat. No. 5,806,391.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of cutting guide devices and in particular to a cutting guide apparatus for the cutting and shaping of commercial and residential insulation.

2. Description of Related Art

As can be seen by reference to the following U.S. Pat. Nos. 5,075,974; 5,353,508; 5,404,647; and 5,485,676, the prior art is replete with myriad and diverse cutting tools and guides for cutting and/or severing a wide variety of materials.

While all of the aforementioned prior art constructions are more than adequate for the basic purpose and function for which they have been specifically designed, they are neither designed nor suited to fulfill the role that is fulfilled by the subject matter of the present invention.

As anyone who has worked with rolls of insulation is all too painfully aware, the process of cutting unrolled sheets of insulation is time consuming and for the most part, unprecise procedure that results not only in wasted material, but also in unevenly severed sheets of insulating material having gaps along one or both sides which adversely affect the effectiveness of the installed insulation.

As a consequence of the foregoing situation, there has existed a longstanding need among both professional and unskilled insulation installers for a new type of insulation cutting guide apparatus that will allow quick, clean, and precise straight edge cuts to be made in a sheet of insulation and the provision of such a construction is a stated objective of the present invention.

BRIEF SUMMARY OF THE INVENTION

Briefly stated, the insulation cutting guide apparatus that forms the basis of the present invention comprises a slotted framework unit, a pair of stabilizing units, and an alignment unit which are all operatively associated with the slotted framework unit.

As will be explained in greater detail further on in the specification, the slotted framework unit cooperates with the pair of stabilizing units to compress the sheet of insulating material in an area immediately adjacent and surrounding the location that will be severed by a cutting tool.

In addition, the stabilizing units provide support surfaces for both the user's arm and at least one of the users legs during the severing process, such that the apparatus and the associated cutting slot will remain properly aligned as determined by the initial positioning of the reference unit.

As will also be explained in greater detail further on in the specification, the cutting slot in the framework unit not only serves as a guide for the cutting implement, but is also optionally configured to slow the motion of the cutting blade at the end of the severing stroke for prevention of injuries caused by the accidental slippage of the cutting blade.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the insulation cutting guide apparatus that forms the basis of the present invention;

FIG. 2 is a top plan view of the apparatus; and

FIG. 3 is a left side plan view of the apparatus.

DETAILED DESCRIPTION OF THE INVENTION

As can be seen by reference to the drawings, and in particularly to FIG. 1, the insulation cutting guide apparatus that forms the basis of the present invention is designated generally by the reference number 10. The apparatus 10 is designed to cooperate with a cutting implement 100 to produce straight line cuts in a sheet of insulating material 200 and comprises in general a slotted framework unit 11, a pair of stabilizing units 12 and 13 and an alignment unit 14. These units will now be described in seriatim fashion.

As can best be seen by reference to FIGS. 1 and 2, the slotted framework unit 11 comprises a generally flat elongated rectangular tubular open framework member 20 provided with an elongated aperture 21. In the preferred embodiment of the invention, the elongated aperture 21 has a generally uniform width extending along its entire length. However, in the alternate version of the preferred embodiment the aperture 21' is provided with a tapered configuration as indicated by the dashed lines in FIG. 2.

In both versions of the preferred embodiment, the apertures 21, 21' are dimensioned to receive and guide the handle 101 of the cutting implement 100 along at least one of the interior edges of the open framework member 20. However, in the alternate version the tapered aperture 21' is provided to slow the progress of the cutting stroke as the cutting implement 101 approaches the bottom portion of the framework member 20.

As shown in FIGS. 1 through 3, the stabilizing units 12 and 13 comprise a cushioned kneeling pad member 30 disposed on the lower portion of the framework member 20 and projecting outwardly from the inboard edge thereof and a hand grip member 40 centrally disposed on the upper portion of the framework member 20.

In the preferred embodiment of the invention depicted in FIG. 1, the hand grip member 40 is disposed at an obtuse angle relative to the user. In the alternate embodiment depicted in FIG. 3, the hand grip member 40 is disposed generally perpendicular to the framework member 20.

Furthermore, in the embodiment of FIG. 1, the kneeling pad member 30 is disposed generally parallel to the lower inboard edge of the framework member 20 and dimensioned to accommodate only one of the user's knees. In the embodiment of FIG. 2, the kneeling pad member 30 is disposed generally perpendicular to the lower inboard edge of the framework member 20 and dimensioned to accommodate both of the user's knees.

As can be seen by reference to FIGS. 1 through 3, the alignment unit 14 comprises an elongated alignment member 50 which projects outwardly from the upper portion of the framework member 20 and which is disposed in a perpendicular fashion relative to the inboard edge of the framework member 20. The alignment member 50 is provided to give the user a frame of reference to produce a straight cut of the insulation material 200 parallel to one of the sides of the sheet of insulating material 200 by placing the upper edge of the alignment member 50 on, adjacent to, or parallel with the upper edge of the sheet of insulating material in a well recognized fashion.

It should also be noted at this juncture that the alignment member 50 also functions to immobilize the upper uncut portion of the insulating material 200 proximate to the initiation of the severing of the insulation material at that location.

In operation, the user would place the apparatus 10 on top of a sheet of insulation material 200 that the user wished to trim to a particular size. The user would then position the alignment member 50 relative to the leading edge of the sheet of insulation material such that one edge of the aperture 21 or 21' would be disposed parallel to the side of the insulation material 100 that is to be trimmed away.

At this point, the user would rest one knee on the kneeling pad member 30 and grasp the hand grip member 40 to both stabilize the apparatus 10 and compress the sheet of insulation material 200 in the area surrounding the location of the desired cut. The user would then insert the blade 102 of the cutting implement 100 into the aperture 21 or 21' and use on of the elongated interior edges of the framework member 20 to guide the handle 101 of the cutting implement 100 during the severing process.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. An insulation cutting guide apparatus for assisting a user in making an elongated straight edged cut in an unrolled sheet of insulating material with a cutting implement wherein the cutting guide apparatus comprises:

a framework unit including an elongated generally flat rectangular open framework member having an elongated aperture formed therein, wherein said aperture is dimensioned to receive a portion of said cutting implement, and the elongated inboard edges of said aperture forms a guide surface for said cutting implement;

alignment means for aligning the elongated inboard edge relative to an uncut edge of the sheet of insulation material; and restraining means for compressing the sheet of insulating material in a location surrounding the area that is to be cut by the cutting implement and including a hand grip member fixedly secured to, and projecting upwardly from the upper portion of the framework member at an obtuse angle.

2. The apparatus as in claim 1 wherein the elongated interior edges of the framework member are disposed parallel to one another.

3. The apparatus as in claim 1 wherein the elongated interior edges of the framework member are disposed at an angle to one another.

4. The apparatus as in claim 1 wherein said alignment means includes an elongated alignment member which projects outwardly from the upper portion of the framework member and is disposed perpendicular to the inboard side of the framework member.

5. The apparatus as in claim 1 wherein the restraining means further includes a knee pad member projecting outwardly from the lower portion of the inboard side of the framework member.

6. The apparatus as in claim 5 wherein the knee pad member is disposed generally parallel to the inboard side of the framework member.

7. The apparatus as in claim 5 wherein the knee pad member is disposed generally perpendicular to the inboard side of the framework member.

8. The apparatus as in claim 4 wherein said restraining means includes a knee pad member projecting outwardly from the lower portion of the inboard side of the framework member.

9. The apparatus as in claim 4 wherein said alignment member comprises an elongated generally flat rectangular alignment element.

10. The apparatus as in claim 1 further including:

means associated with the framework unit for slowing the movement of the cutting implement relative to the framework aperture.

* * * * *